US012747488B2

(12) United States Patent
Wang et al.

(10) Patent No.: US 12,747,488 B2
(45) Date of Patent: Sep. 29, 2026

(54) CARBIDE REFINING METHOD OF HIGH-CARBON HIGH-ALLOY STEEL

(71) Applicant: SHANGHAI JIAOTONG UNIVERSITY, Shanghai (CN)

(72) Inventors: Yujie Wang, Shanghai (CN); Bo Mao, Shanghai (CN); Jiao Zhang, Shanghai (CN); Baode Sun, Shanghai (CN); Qing Dong, Shanghai (CN); Jiangbo Yang, Shanghai (CN); Haitao Jiang, Shanghai (CN)

(73) Assignee: SHANGHAI JIAOTONG UNIVERSITY, Shanghai (CN)

( * ) Notice: Subject to any disclaimer, the term of this patent is extended or adjusted under 35 U.S.C. 154(b) by 482 days.

(21) Appl. No.: 18/280,419

(22) PCT Filed: Jun. 30, 2023

(86) PCT No.: PCT/CN2023/104782
§ 371 (c)(1),
(2) Date: Sep. 5, 2023

(87) PCT Pub. No.: WO2023/213334
PCT Pub. Date: Nov. 9, 2023

(65) Prior Publication Data

US 2024/0167135 A1 May 23, 2024

(30) Foreign Application Priority Data

May 6, 2022 (CN) ..... 202210485310.1

(51) Int. Cl.
*C22C 38/36* (2006.01)
*B22D 17/20* (2006.01)
(Continued)

(52) U.S. Cl.
CPC ..... *C22C 38/36* (2013.01); *B22D 17/2023* (2013.01); *C21D 1/19* (2013.01);
(Continued)

(58) Field of Classification Search
CPC ..... C22C 38/36; C22C 38/02; C22C 38/04; C22C 38/22; C22C 38/24; C22C 33/04;
(Continued)

(56) References Cited

U.S. PATENT DOCUMENTS 5,976,277 A 11/1999 Park et al.
11,180,820 B1 11/2021 Huang et al.

FOREIGN PATENT DOCUMENTS

CN 1916219 A 2/2007
CN 1940112 A * 4/2007
(Continued)

OTHER PUBLICATIONS

English Abstract of cited patent documents.
(Continued)

*Primary Examiner* — Ricardo D Morales
(74) *Attorney, Agent, or Firm* — Whitestone Law, PLLC

(57) ABSTRACT

The present disclosure provides a carbide refining method of a high-carbon high-alloy steel. The carbide refining method of a high-carbon high-alloy steel includes the following steps: formulating a raw material according to chemical element compositions of the high-carbon high-alloy steel, and smelting to obtain a high-carbon high-alloy molten steel; performing an overheat treatment on the high-carbon high-alloy molten steel to Tm+(50~100)° C., to obtain a high-carbon high-alloy melt, and making the high-carbon high-alloy melt to be deposited in a preset water-cooled copper mold at a speed of 30~160 g/s by an inert gas, to
(Continued)

obtain a high-carbon high-alloy billet through solidification molding; and performing a heat treatment process on the high-carbon high-alloy billet.

13 Claims, 3 Drawing Sheets

(51) Int. Cl.

| | |
|---|---|
| ***C21D 1/19*** | (2006.01) |
| ***C21D 1/58*** | (2006.01) |
| ***C21D 1/60*** | (2006.01) |
| ***C22C 38/02*** | (2006.01) |
| ***C22C 38/04*** | (2006.01) |
| ***C22C 38/22*** | (2006.01) |
| ***C22C 38/24*** | (2006.01) |

(52) U.S. Cl.
CPC ..... *C21D 1/58* (2013.01); *C21D 1/60* (2013.01); *C22C 38/02* (2013.01); *C22C 38/04* (2013.01); *C22C 38/22* (2013.01); *C22C 38/24* (2013.01)

(58) Field of Classification Search
CPC ..... C22C 38/002; C22C 38/42; C22C 38/44; B22D 17/2023; B22D 17/00; B22D 7/00; B22D 17/2015; B22D 17/32; C21D 1/19; C21D 1/58; C21D 1/60; C21D 1/18; C21D 6/002; C21D 6/005; C21D 6/008; C21D 2211/004; Y02P 10/20
See application file for complete search history.

(56) References Cited

FOREIGN PATENT DOCUMENTS

| | | | |
|---|---|---|---|
| CN | 1958833 | A | 5/2007 |
| CN | 102605263 | A | 7/2012 |
| CN | 104894482 | A | 9/2015 |
| CN | 108411220 | A | 8/2018 |
| CN | 110947935 | A | 4/2020 |
| CN | 113099723 | A | 7/2021 |
| CN | 113201628 | A | 8/2021 |
| CN | 114850436 | A | 8/2022 |
| GB | 2527387 | A | 12/2015 |

OTHER PUBLICATIONS

English translation International Search Report issued on International Application No. PCTCN2023104782.
English translation of Notification to Grant Patent Right for Invention of priority application CN202210485310.1.
English translation of OA1 of priority application of CN202210485310.1.
English translation of Written Opinion of the International Searching Authority issued on International Application No. PCTCN2023104782.
Aug. 18, 2023 International Search Report issued on International Application No. PCTCN2023104782.
Mar. 26, 2023 Notification to Grant Patent Right for Invention of priority application CN202210485310.1.
Dec. 2, 2022 OA1 of priority application of CN202210485310.1.
Aug. 18, 2023 Written Opinion of the International Searching Authority issued on International Application No. PCTCN2023104782.

* cited by examiner

CARBIDE REFINING METHOD OF HIGH-CARBON HIGH-ALLOY STEEL

CROSS REFERENCE TO RELATED APPLICATIONS

The present disclosure claims priority to the Chinese patent application CN202210485310.1 filed with the Chinese Patent Office on May 6, 2022 and entitled "Carbide Refining Method of High-Carbon High-Alloy Steel", the contents of which are incorporated herein by reference in entirety.

TECHNICAL FIELD

The present disclosure relates to the field of alloy steel manufacturing methods, and in particular to a carbide refining method of a high-carbon high-alloy steel.

BACKGROUND ART

At present, high-carbon high-alloy steel, due to its high carbon content and high alloy element content, is easy to form coarse eutectic carbides, has serious segregation, and causes in non-uniform structure, which seriously restricts mechanical property and wear resistance of the high-carbon high-alloy steel. There are mainly the following manufacturing methods of high-carbon high-alloy steel: conventional casting method, electroslag remelting method, spray forming method, and powder metallurgy method. Among the above manufacturing methods, the conventional casting method and the electroslag remelting method are widely applied to large-batch industrial production, but cannot effectively solve the problem of coarse carbides in the structure, and have serious segregation. Spray forming is of a rapid solidification technology, which atomizes refined liquid metal into droplet jet flow, makes semi-solidified droplet particles to be deposited on a substrate, and rapidly solidified to form billets. Although the method of spray forming can achieve structure refinement and composition uniformity of metal material, and eliminate macroscopic segregation, this method has a relatively low degree of refinement of structure, and tends to cause over-spraying of sprayed droplets, thus the yield is low, and the metal material formed has a loose structure, and has inherent pores.

SUMMARY

The present disclosure aims at providing a carbide refining method of a high-carbon high-alloy steel, which can render a high-carbon high-alloy steel with a dense structure and fine carbides.

The present disclosure provides a carbide refining method of a high-carbon high-alloy steel, which includes the following steps:

formulating a raw material according to chemical element compositions of the high-carbon high-alloy steel, and smelting the raw material to obtain a high-carbon high-alloy molten steel;

performing an overheat treatment on the high-carbon high-alloy molten steel to Tm+(50~100) ° C., to obtain a high-carbon high-alloy melt, and making the high-carbon high-alloy melt deposited in a preset water-cooled copper mold at a speed of 30~160 g/s by an inert gas, to obtain a high-carbon high-alloy billet through solidification molding; and performing a heat treatment process on the high-carbon high-alloy billet.

In the above technical solution, the alloy molten steel is subjected to the overheat treatment, and when the alloy melt reaches a predetermined temperature, the melt is deposited in the water-cooled copper mold at a certain speed under the effect of the inert gas, and molded and solidified to form the high-carbon high-alloy billet with fine carbides. The subsequent heat treatment process further changes microstructure and distribution of the high-carbon high-alloy steel, thereby improving the service lifetime thereof.

In the above, a degree of overheat should not be too high, otherwise grains of the solidified structure are caused to be coarse; and the degree of overheat should not be too low, otherwise the fluidity is poor, such that rapid impact is not easy to achieve, and the nozzle is prone to being blocked.

In the above, the melt is impacted and molded at a certain speed. The impact effect is capable of fragmenting the grains and primary carbides, which not only can refine the grains and carbides, and greatly reduce the generation of pores, but also has a high utilization rate of the melt, without wasting the melt. The difference of the melt impact method from the existing spray forming method lies mainly in that the formed billet has a dense and uniform microstructure, and fine carbides; and in the subsequent heat treatment process, the grains are recrystallized on the basis of dislocation and fragmented primary carbides, to achieve fine grains, fine carbides, and uniform distribution, which is capable of improving the strength, toughness, and wear resistance of the high-carbon high-alloy steel, and improving the service lifetime.

Optionally, the high-carbon high-alloy steel includes the following chemical compositions by weight percentage: C: 1.5~2.5%, W: 2.5~10%, Mo: 3~7%, Cr: 4~6%, V: 2~10%, Si: 0.3~0.6%, Mn: 0.3~0.8%, and balance of Fe.

In the above technical solution, the carbon is controlled to have a content of 1.5~2.5%, where one part enters matrix to cause solid solution strengthening, thereby ensuring strength and hardness of the matrix; and the other part is combined with alloy elements to form various types of alloy carbides. If the carbon content is insufficient, it will cause insufficient secondary hardening capacity, and reduce strength and hardness of the matrix, and meanwhile the amount of primary carbides is also reduced relatively, so that the wear resistance and service lifetime of the steel are reduced; on the contrary, if the carbon content is too high, a large amount of alloy carbides are formed, the nonuniformity of the carbides is significantly increased, and finally plasticity, toughness and forgeability of the steel are greatly decreased.

The tungsten content is controlled to be 2.5~10%, to form a certain amount of insoluble primary carbides, and improve the wear resistance of the steel. Moreover, the growth of grains can be hindered during quenching, thereby refining the grains. When the tungsten content is too high, the density is increased, and it is prone to precipitating coarse fishbone $M_6C$ eutectic carbide during solidification, which is detrimental to plasticity.

The molybdenum is controlled to have a content of 3~7%, which not only can enter the matrix to cause solid solution strengthening, but also can form $M_2C$ and $M_6C$ carbides with carbon. The molybdenum has an effect similar to that of tungsten in the high-carbon high-alloy steel.

The chromium content is controlled to be 4~6%. Cr is one of the most advantageous elements for improving hardenability. When Cr cooperates with elements such as W, Mo, and V, a mismatching degree between a precipitated phase of secondary carbide and the matrix can be reduced, so that activation energy of nucleation is reduced, and dense dispersion and precipitation of a large amount of secondary carbides is promoted, thus having an important contribution to secondary hardening. If the chromium content is too low, the hardenability of the high-carbon high-alloy steel is seriously affected. Particularly for the high-carbon high-alloy steel, the hardenability is extremely important, and sufficient hardenability of the high-carbon high-alloy steel can be ensured only with an appropriate chromium content. However, an excessively high chromium content can easily promote tempering brittleness of the high-alloy steel, which is harmful to plasticity.

The vanadium content is controlled to be 2~10%. One part is solubilized in the matrix, and the other part forms primary MC carbides with C. The vanadium solubilized in the matrix can significantly enhance secondary hardening effect of the steel, and undissolved VC carbide hinders growth of the grains during quenching and heating, and meanwhile can significantly improve the wear resistance of the steel. If the vanadium content is too low, it is adverse to the hardness and wear resistance of the high-carbon high-alloy steel, and if the vanadium content is too high, a large amount of MC carbides are formed, but the MC carbides have extremely high hardness and great brittleness, which is disadvantage to the plasticity and toughness of the steel.

The manganese content is controlled to be 0.3~0.8%. In a low content range, manganese has good deoxidization and desulfurization effects, contributes to the strength and wear resistance of the high-alloy steel, and improves the hardenability. Manganese can eliminate or weaken the hot brittleness of steel caused by sulfur, thereby improving the hot processing performance of the high-alloy steel. However, an increase in the manganese content will lead to an increased content of residual austenite, and reduce thermal stability and hardness of the high-carbon high-alloy steel.

The silicon content is controlled to be 0.3~0.6%. Silicon can strengthen the matrix, improve the strength, hardness, and hardenability of the high-alloy steel, inhibit formation of $M_3C$, refine the $M_3C$, and promote conversion of $M_2C$ to MC and $M_7C_3$, etc. However, if the silicon content is too high, it is easy to promote formation of coarse primary MC, increase the decarbonization tendency of the high-alloy steel, and reduce the tempering stability of the high-alloy steel.

Optionally, the heat treatment process includes high-temperature solution treatment, low-temperature interrupted quenching, and tempering treatment performed in sequence, wherein the high-temperature solution treatment is to keep a temperature at 900~1050° C. for 15~60 minutes; the low-temperature interrupted quenching is to keep a temperature at 700~860° C. for 1~2 hours; and the tempering treatment is to keep a temperature at 520~580° C. for 3~4 hours.

In the above technical solution, the billet is subjected to the heat treatment process, which is a further operation and continuation of refining the carbides. The microstructure of the fine carbides of the billet is maintained to a final state after the heat treatment. Firstly, the high-temperature solution treatment is performed on the high-carbon high-alloy billet, which is for the purposes of making the fine carbides sufficiently dissolved in the matrix, and meanwhile eliminating some coarse residual carbides to dissolve the same. Since the billet has fine carbides, the use of high-temperature solution treatment can reduce heat preservation time and save energy. The purpose of interrupted quenching is to refine the matrix grains, and make the carbides spheroidized. As the carbides have been sufficiently dissolved after the high-temperature solution treatment, the subsequent interrupted quenching temperature can be reduced without the need of a high austenitization temperature, and a low interrupted quenching temperature avoids aggregation and growth of the carbides. The tempering treatment aims at adjusting the hardness and toughness of the high-carbon high-alloy steel, and meanwhile releasing residual stress.

Optionally, after the high-temperature solution treatment is completed, oil quenching is performed to room temperature, and then low-temperature interrupted quenching is performed;

and/or, after the low-temperature interrupted quenching is completed, water quenching is performed to a martensite transformation point, oil quenching is performed to room temperature, and then tempering treatment is performed.

In the above technical solution, after the high-temperature solution treatment is performed for a pre-set heat preservation time, the resultant is discharged from furnace and subjected to oil quenching to room temperature. After the low-temperature interrupted quenching is completed, rapid water quenching is performed to point M (martensite transformation point), which aims at maintaining a fine size of the carbides, and avoids a slow cooling speed to make it fully grow up. Meanwhile, rapid cooling improves dislocation distribution, and enhances the strength of the matrix. Oil quenching is performed after point M, for the purpose of avoiding occurrence of quenching deformation, cracking or the like after room temperature.

Optionally, a method of the overheat treatment includes: vacuumizing a chamber where the high-carbon high-alloy molten steel is located to 100~400 Pa, subsequently filling the inert gas for protection, and then heating the high-carbon high-alloy molten steel to obtain the high-carbon high-alloy melt.

Optionally, the overheat treatment is performed by a coil heating method.

Optionally, a method of depositing the melt includes: filling the inert gas for protection, and after heating the high-carbon high-alloy molten steel to obtain the high-carbon high-alloy melt, continuing to fill the inert gas to make the high-carbon high-alloy melt sprayed to an external chamber.

In the above technical solution, the chamber is vacuumized, and then filled with inert atmosphere for protection, and when the melt reaches an overheat temperature, an inert gas flow is filled into the melt, so that the melt has a certain pressure difference with the external chamber, which promotes the melt to be sprayed rapidly. The spraying is mainly controlled by means of airflow, which is easy to realize and operate.

Optionally, the high-carbon high-alloy melt is deposited under an effect of pressure difference, wherein the pressure difference is 0.05~0.25 MPa.

In the above technical solution, a too large pressure difference easily causes melt splashing; and if the pressure difference is below this pressure difference range, an effective impact force cannot be formed, and the coarse eutectic structure cannot be effectively refined.

Optionally, a distance between an outlet of a nozzle of the chamber where the high-carbon high-alloy melt is located and the water-cooled copper mold is 11~20 cm;

and/or, a water outlet of the water-cooled copper mold has a temperature of 30~45° C.

In the above technical solution, if a spraying distance is too small, it is prone to causing splashing of the alloy molten steel; and if the spraying distance is too large, the effective impact force cannot be maintained.

Optionally, the outlet of the nozzle is in a round hole shape or a slit shape, and all nozzles are arranged in an array.

BRIEF DESCRIPTION OF DRAWINGS

In order to more clearly illustrate technical solutions of examples of the present disclosure, drawings that need to be used in the examples of the present disclosure will be briefly introduced below. It should be understood that the following drawings only show some of the examples of the present disclosure, and therefore should not be regarded as limitation to the scope. For those ordinarily skilled in the art, other related drawings can also be obtained from these drawings without using any inventive efforts.

DETAILED DESCRIPTION OF EMBODIMENTS

Figure 1:
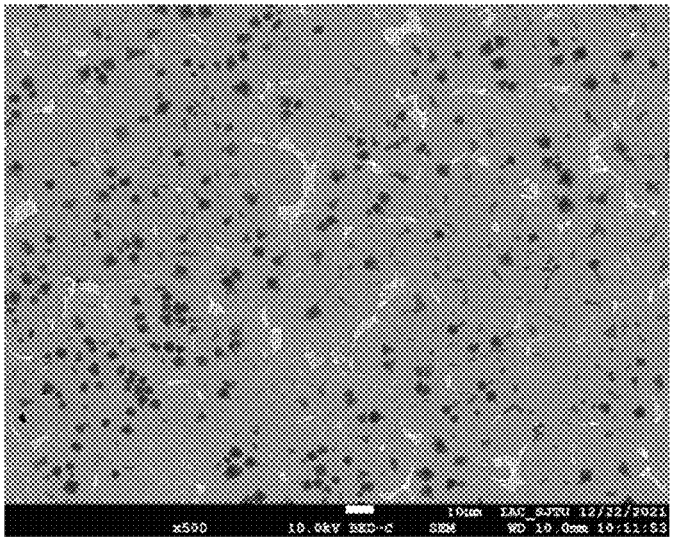
FIG. 1 is a microstructure diagram of a billet obtained in Example 1.

The applicant found that, due to a high carbon content and alloy elements, the high-carbon high-alloy steel is easy to form coarse eutectic carbides, and has serious segregation. A casting state (casting obtained by molding) microstructure of the current high-carbon high-alloy steel is extremely non-uniform, and mainly consists of martensite, residual austenite, and various carbides. The various carbides (such as the commonest MC, $M_2C$, and $M_6C$) are non-uniformly distributed, with varied forms, and especially coarse reticulated eutectic carbides are distributed at grain boundary, split the matrix and worsen the service performance. With regard to the high-carbon high-alloy steel casting, refining the carbides and making the same uniformly distributed are particularly crucial for the subsequent thermal-mechanical deformation and improvement for mechanical performance. As the coarse reticulated eutectic carbides of the casting are fragmented by subsequent forging, rolling and other processes, the mechanical performance is seriously affected; and even if forging and rolling processes are used, it is still difficult to make the carbides refined evenly and distributed diffusively, and meanwhile the costs are increased.

In addition, most of high-carbon high-alloy steel products are castings, that is, thermal mechanical deformation is no longer performed subsequently. There is only the heat treatment, but the heat treatment cannot change the distribution or morphology of the coarse carbides at all. For example, the billet fabricated by the existing spray forming technology have inherent pores, and for cast alloy steel, since the forging process is not included subsequently, pores of the billets after the heat treatment still exist, then the service lifetime is greatly reduced. Therefore, by refining the coarse eutectic carbides, the high-carbon high-alloy steel casting has an initial microstructure with fine carbides, which is extremely important to improve the mechanical performance.

In the present disclosure, the liquid flow is used to rapidly impact the liquid-solid interface of a self-stirring molten pool, such that a high-speed impact force makes the dendrite fragmented, thereby adding nucleation particles, and creating condition for refining the grains. Then in combination with a specific heat treatment process, it has a significant effect on refining the primary carbides of the high-carbon high-alloy steel billet.

In order to make objectives, technical solutions, and advantages of the examples of the present disclosure clearer, the technical solutions in the examples of the present disclosure will be described below clearly and completely. If no specific conditions are specified in the examples, they are carried out under normal conditions or conditions recommended by manufacturers. If manufacturers of reagents or apparatuses used are not specified, they are conventional products commercially available.

A carbide refining method of a high-carbon high-alloy steel according to examples of the present disclosure is specifically described below.

An example of the present disclosure provides a carbide refining method of a high-carbon high-alloy steel, mainly including preparing a high-carbon high-alloy billet by a melt impact method and performing a heat treatment process, which includes the following steps.

(1) Preparing the High-Carbon High-Alloy Billet by the Melt Impact Method

S1, formulating a raw material according to chemical element compositions of the high-carbon high-alloy steel by weight percentage, including C: 1.5~2.5%, W: 2.5~10%, Mo: 3~7%, Cr: 4~6%, V: 2~10%, Si: 0.3~0.6%, Mn: 0.3~0.8%, and balance of Fe, and smelting the raw material to obtain a high-carbon high-alloy molten steel; and S2, vacuumizing a chamber where the high-carbon high-alloy molten steel is located to 100~400 Pa, subsequently filling an inert gas for protection, so that the whole chamber is in an inert atmosphere protection state, and then heating the high-carbon high-alloy molten steel by a coil heating method, wherein overheat treatment is performed to a range higher than a temperature of melting point by 50~100° C., i.e., Tm+(50~100) ° C., so as to obtain a high-carbon high-alloy melt; and continuing to fill the inert gas so that a pressure difference of 0.05~0.25 MPa is formed between the chamber where the high-carbon high-alloy molten steel is located and an external chamber, so as to make the high-carbon high-alloy melt sprayed to the external chamber at a speed of 30~160 g/s under the effect of the pressure difference, and deposited in a pre-set water-cooled copper mold, wherein a distance between an outlet of a nozzle of the chamber where the high-carbon high-alloy melt is located and the water-cooled copper mold is 11~20 cm, and a water outlet of the water-cooled copper mold has a temperature of 30~45° C., thereby obtaining a high-carbon high-alloy billet through solidification molding.

In the examples of the present disclosure, the raw material is placed in a crucible. A medium-frequency induction furnace is used to smelt the raw material to obtain the high-carbon high-alloy molten steel. The chamber of the medium-frequency induction furnace is in a closed state. The raw material is heated into the molten steel by coil, and then the molten steel is overheated into the melt. A graphite nozzle is provided at the bottom of the crucible. The outlet of the nozzle is in a round hole shape or a slit shape, and all nozzles are arranged in an array. The melt is deposited in the water-cooled copper mold at a certain speed through the nozzles under the effect of pressure difference, and shaped and solidified, to render a high-carbon high-alloy billet with fine carbides.

(2) Heat Treatment Process

S3, performing high-temperature solution treatment on the high-carbon high-alloy billet, keeping temperature at 900~1050° C. for 15~60 minutes, and performing oil quenching to room temperature;

S4, performing low-temperature interrupted quenching on the billet having undergone step S3, keeping temperature at 700~860° C. for 1~2 hours, performing water quenching to martensite transformation point (point M), and then performing oil quenching to room temperature; and S5, performing tempering treatment on the billet having undergone step S4, and keeping temperature at 520~580° C. for 3~4 hours, to obtain the high-carbon high-alloy steel.

EXAMPLE

The features and performances of the present disclosure are further described below in detail in combination with examples.

Example 1

The present example provided a high-carbon high-alloy steel, of which a preparation process is as follows:

S1, formulating a raw material in a crucible according to chemical element compositions of the high-carbon high-alloy steel: C: 2.5%, W: 4.1%, Mo: 2.9%, Cr: 5.0%, V: 8.2%, Si: 0.5%, Mn: 0.3%, and balance of Fe, and smelting at a temperature of melting point 1398° C. in a medium-frequency induction furnace, to obtain a high-carbon high-alloy molten steel;

S2, vacuumizing a chamber of the medium-frequency induction furnace to 200 Pa, subsequently filling an inert gas for protection, so that the whole chamber was in an inert atmosphere protection state, and then heating the high-carbon high-alloy molten steel, overheating to 1450° C., i.e., Tm+52° C., to obtain a high-carbon high-alloy melt; and continuing to fill the inert gas so that a pressure difference of 0.15 MPa was formed between the chamber and an external chamber, to promote the high-carbon high-alloy melt in the crucible to be sprayed to the external chamber at a speed of 100 g/s through a nozzle at the bottom of the crucible under the effect of the pressure difference, and deposited in a pre-set water-cooled copper mold, wherein a distance between an outlet of a nozzle and the water-cooled copper mold was 15 cm, and a water outlet of the water-cooled copper mold had a temperature of 40° C., such that a high-carbon high-alloy billet was obtained through solidification molding;

S3, performing high-temperature solution treatment on the high-carbon high-alloy billet, keeping temperature at 1000° C. for 30 minutes, and then performing oil quenching to room temperature;

S4, performing low-temperature interrupted quenching on the billet having undergone step S3, keeping temperature at 800° C. for 1.5 hours, and performing water quenching to martensite transformation point (point M), and then performing oil quenching to room temperature; and S5, performing tempering treatment on the billet having undergone step S4, and keeping temperature at 550° C. for 3.5 hours, to obtain the high-carbon high-alloy steel.

Example 2

The present example provided a high-carbon high-alloy steel, of which a preparation process was different from that of Example 1 in that the pressure difference was controlled to be 0.25 MPa.

Example 3

The present example provided a high-carbon high-alloy steel, of which a preparation process was different from that of Example 1 in that a spraying speed was 50 g/s.

Comparative Example 1

The present comparative example provided a high-carbon high-alloy steel, of which a preparation process was different from that of Example 1 in that the high-carbon high-alloy molten steel was heated to 1450° C., and poured according to the conventional die casting method to obtain a billet, and then the billet was cooled to room temperature.

Comparative Example 2

The present comparative example provided a high-carbon high-alloy steel, of which a preparation process was different from that of Example 1 in that the high-carbon high-alloy molten steel was heated to 1450° C., and poured according to the conventional die casting method to obtain a billet, and then a heat treatment process was performed in the same manner as that of Example 1.

Comparative Example 3

The present comparative example provided a high-carbon high-alloy steel, of which a preparation process was different from that of Example 1 in that the high-carbon high-alloy billet was heated to 800° C., kept at the temperature for 4 h, and naturally cooled with furnace.

Comparative Example 4

The present comparative example provided a high-carbon high-alloy steel, of which a preparation process was different from that of Example 1 in that the overheat treatment was not performed, while the molten steel obtained from the smelting was sprayed, but due to a high viscosity, the alloy melt could not be smoothly sprayed from the nozzle, and easily blocked the nozzle.

Figure 2:
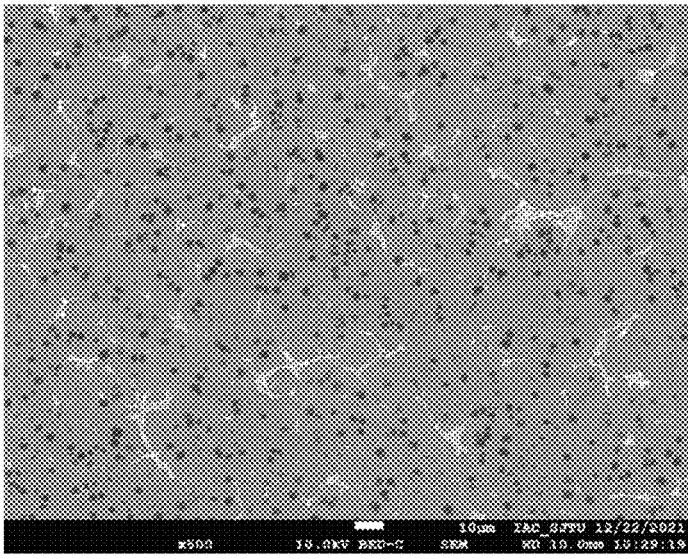
FIG. 2 is a microstructure diagram of a billet obtained in Example 2.
Figure 3:
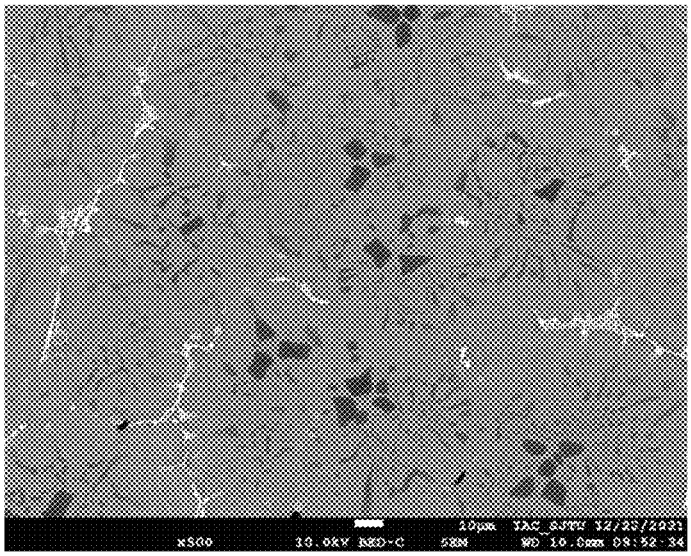
FIG. 3 is a microstructure diagram of a billet obtained in Comparative Example 1.

FIG. 1 is a microstructure diagram of the billet in Example 1, FIG. 2 is a microstructure diagram of the billet in Example 2, and FIG. 3 shows microstructure morphology of the billet in Comparative Example 1. It is noted that FIG. 1-FIG. 3 all show original microstructures having not undergone heat treatment.

It is found through analysis that carbides in the microstructure show two types, wherein gray carbides are MC-type carbides, and white carbides are $M_2C$ carbides. The billets in FIG. 1 and FIG. 2 are formed according to a specific melt impact method, wherein the gray carbides are in a uniformly dispersed granular shape, very fine and uniform, and the white carbides are in a strip shape or rod shape; and the billet in FIG. 2 is subjected to a stronger impact effect, the carbides are finer than the carbides of the billet in FIG. 1. The gray carbides in the billet in FIG. 3 are of various shapes, including petaloid shape and coarse reticulated shape, severely aggregated, and split the matrix, and the white carbides are in a strip shape or a rod shape, and larger in size than those in FIG. 1 and FIG. 2.

In addition, Image-Pro Plus was used to perform statistical analysis on the sizes of two types of carbides in different billet microstructures, as shown in the following table:

| Average size (μm) | MC-type carbide | $M_2C$ carbide |
|---|---|---|
| Example 1 | 3.4 | 9.6 |
| Example 2 | 2.5 | 18.7 |
| Example 3 | 4.9 | 28.1 |
| Comparative Example 1 | 11.6 | 50.5 |
| Comparative Example 2 | 13.8 | / |
| Comparative Example 4 | / | / |

Figure 4:
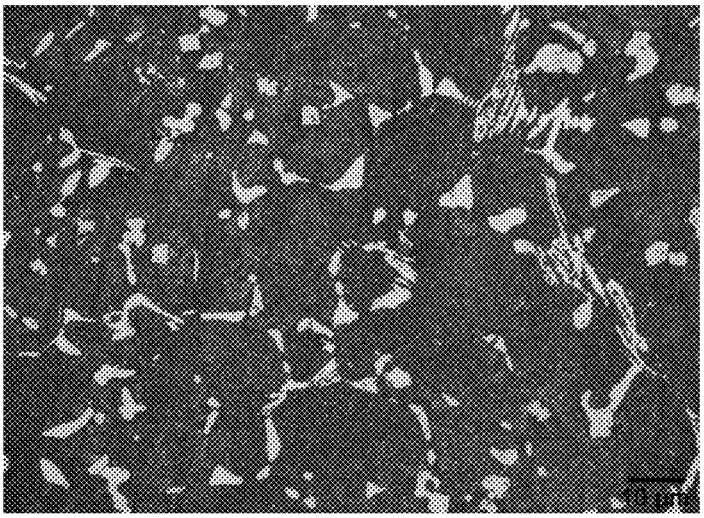
FIG. 4 is a microstructure diagram of high-carbon high-alloy steel obtained in Example 1.

FIG. 4 is a microstructure diagram (optical micrograph) of the high-carbon high-alloy steel (the billet is subjected to a specific heat treatment) in Example 1. It can be seen from FIG. 4 that the microstructure in the final state mainly has MC and $M_6C$ carbides.

By comparing FIG. 1 and FIG. 4, it is analyzed that a reason of the microstructure change is that the MC-type carbides in the billet are stable, and have no change in the subsequent heat treatment; and the $M_2C$ carbides are in a metastable phase, and will be decomposed into MC and $M_6C$ in the subsequent heat treatment. After the billet has undergone the heat treatment, the size of the $M_2C$ carbides can not be counted, which mainly consist of the MC and $M_6C$ carbide.

The microstructure of the high-carbon high-alloy steel (the billet does not undergo a specific heat treatment) in Comparative Example 3 is composed of pearlites and granular carbides. Compared with the alloy steel in Example 1, the alloy steel can be considered as in an intermediate state (spheroidizing annealing), aiming at reducing the alloy hardness and preparing for subsequent quenching-tempering in structure.

To sum up, the carbide refining method of a high-carbon high-alloy steel of the examples of the present disclosure can render the high-carbon high-alloy steel with a dense structure and fine carbides.

The above is merely for examples of the present disclosure and not intended to limit the scope of protection of the present disclosure. For those skilled in the art, various modifications and variations could be made to the present disclosure. Any modifications, equivalent substitutions, improvements and so on, within the spirit and principle of the present disclosure, should be covered within the scope of protection of the present disclosure.

What is claimed is:

1. A carbide refining method of a high-carbon high-alloy steel, comprising following steps:

formulating a raw material according to chemical element compositions of the high-carbon high-alloy steel, and smelting the raw material to obtain a high-carbon high-alloy molten steel;

performing an overheat treatment on the high-carbon high-alloy molten steel to Tm+(50~100° C.), to obtain a high-carbon high-alloy melt, and depositing the high-carbon high-alloy melt in a preset water-cooled copper mold at a speed of 30~160 g/s by an inert gas, to obtain a high-carbon high-alloy billet through solidification molding; and performing a heat treatment process on the high-carbon high-alloy billet.

2. The carbide refining method of a high-carbon high-alloy steel according to claim 1, wherein the high-carbon high-alloy steel comprises a following chemical element compositions by weight percentage: C: 1.5~2.5%, W: 2.5~10%, Mo: 3~7%, Cr: 4~6%, V: 2~10%, Si: 0.3~0.6%, Mn: 0.3~0.8%, and a balance of Fe.

3. The carbide refining method of a high-carbon high-alloy steel according to claim 1, wherein the heat treatment process comprises high-temperature solution treatment, low-temperature interrupted quenching, and tempering treatment performed in sequence, wherein the high-temperature solution treatment is to keep a temperature at 900~1050° C. for 15~60 minutes; the low-temperature interrupted quenching is to keep a temperature at 700~860° C. for 1~2 hours; and the tempering treatment is to keep a temperature at 520~580° C. for 3~4 hours.

4. The carbide refining method of a high-carbon high-alloy steel according to claim 3, wherein after the high-temperature solution treatment is completed, oil quenching is performed to room temperature, and then low-temperature interrupted quenching is performed; and/or after the low-temperature interrupted quenching is completed, water quenching is performed to a martensite transformation point, oil quenching is performed to room temperature, and then the tempering treatment is performed.

5. The carbide refining method of a high-carbon high-alloy steel according to claim 1, wherein a method for the overheat treatment comprises: vacuumizing a chamber where the high-carbon high-alloy molten steel is located to 100~400 Pa, subsequently filling an inert gas for protection, and then heating the high-carbon high-alloy molten steel to obtain the high-carbon high-alloy melt.

6. The carbide refining method of a high-carbon high-alloy steel according to claim 1, wherein the overheat treatment is performed by a coil heating method.

7. The carbide refining method of a high-carbon high-alloy steel according to claim 5, wherein a method of depositing the melt comprises: filling the inert gas for protection, and after heating the high-carbon high-alloy molten steel to obtain the high-carbon high-alloy melt, continuing to fill the inert gas to make the high-carbon high-alloy melt sprayed to an external chamber.

8. The carbide refining method of a high-carbon high-alloy steel according to claim 1, wherein the high-carbon high-alloy melt is deposited under an effect of pressure difference, and the pressure difference is 0.05~0.25 MPa.

9. The carbide refining method of a high-carbon high-alloy steel according to claim 1, wherein a distance between an outlet of a nozzle of the chamber where the high-carbon high-alloy melt is located and the water-cooled copper mold is 11~20 cm; and/or a water outlet of the water-cooled copper mold has a temperature of 30~45° C.

10. The carbide refining method of a high-carbon high-alloy steel according to claim 9, wherein an outlet of a nozzle is in a round hole shape or a slit shape, and all nozzles are arranged in an array.

11. The carbide refining method of a high-carbon high-alloy steel according to claim 5, wherein the overheat treatment is performed by a coil heating method.

12. The carbide refining method of a high-carbon high-alloy steel according to claim 7, wherein the high-carbon high-alloy melt is deposited under an effect of pressure difference, and the pressure difference is 0.05~0.25 MPa.

13. The carbide refining method of a high-carbon high-alloy steel according to claim 7, wherein a distance between an outlet of a nozzle of the chamber where the high-carbon high-alloy melt is located and the water-cooled copper mold is 11~20 cm; and/or a water outlet of the water-cooled copper mold has a temperature of 30~45° C.

* * * * *